US010323477B2

(12) United States Patent
Smith

(10) Patent No.: US 10,323,477 B2
(45) Date of Patent: Jun. 18, 2019

(54) SEAL ASSEMBLY

(71) Applicant: Weatherford Technology Holdings, LLC, Houston, TX (US)

(72) Inventor: Roddie R. Smith, Katy (GB)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 992 days.

(21) Appl. No.: 13/652,137

(22) Filed: Oct. 15, 2012

(65) Prior Publication Data

US 2014/0102725 A1 Apr. 17, 2014

(51) Int. Cl.
*E21B 33/128* (2006.01)
*E21B 34/10* (2006.01)

(52) U.S. Cl.
CPC ..... *E21B 33/128* (2013.01); *E21B 33/1285* (2013.01); *E21B 34/10* (2013.01); *E21B 34/105* (2013.01)

(58) Field of Classification Search
CPC .. E21B 2033/005; E21B 23/08; E21B 33/128; E21B 33/1285; E21B 33/1216; E21B 34/10; E21B 34/105
See application file for complete search history.

(56) References Cited

U.S. PATENT DOCUMENTS 3,339,637 A 9/1967 Holden
3,394,762 A 7/1968 Young
3,865,141 A 2/1975 Young
4,252,197 A 2/1981 Pringle
4,279,306 A 7/1981 Weitz
4,340,088 A 7/1982 Geisow
4,406,469 A * 9/1983 Allison ..... 277/342
4,420,043 A 12/1983 Brooks
4,428,557 A 1/1984 Yonker et al.
4,605,070 A 8/1986 Morris
4,691,776 A 9/1987 Pringle
4,729,433 A 3/1988 Jacob et al.
4,834,175 A 5/1989 Ross et al.
(Continued)

FOREIGN PATENT DOCUMENTS

EP 2357316 A2 8/2011
GB 2190941 12/1987
GB 2 366 579 A 3/2002

OTHER PUBLICATIONS

GB Search Report, Application No. GB720337.5, dated Feb. 4, 2008.

(Continued)

*Primary Examiner* — David J Bagnell
*Assistant Examiner* — Christopher J Sebesta
(74) *Attorney, Agent, or Firm* — Patterson + Sheridan, LLP

(57) ABSTRACT

A seal assembly for use in a tubular includes a mandrel, a compressible seal member disposed around the mandrel, a first piston assembly in contact with a first end of the seal member, and a second piston assembly in contact with a second end of the seal member. The first piston assembly includes a piston head, and a piston extension sealing member integrally formed with the piston head, and extending at least partially between the mandrel and the compressible seal member. The compressible seal member forms a seal with the tubular when at least one of the piston assemblies is urged toward the compressible seal member.

14 Claims, 6 Drawing Sheets

(56) References Cited

U.S. PATENT DOCUMENTS

| | | | | |
|---|---|---|---|---|
| 4,836,287 | A | 6/1989 | Eric et al. | |
| 5,305,828 | A | 4/1994 | White et al. | |
| 5,586,601 | A | 12/1996 | Pringle | |
| 6,902,008 | B2 * | 6/2005 | Hirth et al. | 166/387 |
| 7,055,607 | B2 | 6/2006 | Jacob | |
| 7,779,925 | B2 | 8/2010 | Jacob | |
| 2003/0132008 | A1 | 7/2003 | Hirth et al. | |
| 2005/0161232 | A1 * | 7/2005 | Patel et al. | 166/386 |
| 2005/0178559 | A1 | 8/2005 | Jacob | |
| 2007/0056747 | A1 * | 3/2007 | Jacob | 166/386 |
| 2008/0202771 | A1 * | 8/2008 | Carisella et al. | 166/387 |
| 2011/0186307 | A1 * | 8/2011 | Derby | 166/386 |
| 2013/0306331 | A1 * | 11/2013 | Bishop | E21B 33/128 166/387 |

OTHER PUBLICATIONS

UK Search Report, Application No. GB0502967.3, dated Jun. 7, 2005.

Australian Patent Examination Report dated Feb. 25, 2016, for Australian Patent Application No. 2013242846.

Australian Patent Examination Report for Application No. 2013242846 dated Mar. 20, 2015; 5 total pages.

EP Search Report for Application No. 13188451.2-1605/2719856 dated Jun. 29, 2016.

* cited by examiner

SEAL ASSEMBLY

BACKGROUND OF THE INVENTION

Field of the Invention

Embodiments of the invention generally relate to tools having a seal assembly for sealing an annulus between a tubular seat in the wellbore and the outside of the tool disposed in the tubular seat.

Description of the Related Art

Surface-controlled, subsurface safety valves (SCSSVs) and plugs are commonly used to shut-in oil and/or gas wells. The SCSSV or plug fits into tubing in a hydrocarbon producing well and operates to block upward flow of formation fluid through the tubing. The tubing may include a landing nipple designed to receive the SCSSV or plug therein such that the SCSSV or plug may be installed and retrieved by wireline. During conventional methods for run-in of the SCSSV or plug to the landing nipple, a tool used to lock the SCSSV or plug in place within the nipple also temporarily holds the SCSSV or plug open until the SCSSV or plug is locked in place.

Most SCSSVs are "normally closed" valves, i.e., the valves utilize a flapper type closure mechanism biased to a closed position. During normal production, application of hydraulic fluid pressure transmitted to an actuator of the SCSSV maintains the SCSSV in an open position. A control line that resides within the annulus between production tubing and a well casing may supply the hydraulic pressure to a port in the nipple that permits fluid communication with the actuator of the SCSSV. In many commercially available SCSSVs, the actuator used to overcome the bias to the closed position is a hydraulic actuator that may include a rod piston or concentric annular piston. During well production, the flapper is maintained in the open position by a flow tube acted on by the piston to selectively open the flapper member in the SCSSV. Any loss of hydraulic pressure in the control line causes the piston and actuated flow tube to retract, which causes the SCSSV to return to the normally closed position. Thus, the SCSSV provides a shutoff of production flow once the hydraulic pressure in the control line is released.

The landing nipple within the tubing may become damaged by operations that occur through the nipple prior to setting the SCSSV or plug in the landing nipple. For example, operations such as snubbing and tool running using coiled tubing and slick line can form gouges, grooves, and/or ridges along the inside surface of the nipple as the operations pass through the nipple. Further, any debris on the inside surface of the nipple or any out of roundness of the nipple may prevent proper sealing of the SCSSV or plug within the nipple. Failure of the SCSSV or plug to seal in the nipple due to surface irregularities in the inner diameter of the nipple can prevent proper operation of the actuator to open the SCSSV and can prevent the SCSSV or plug from completely shutting-in the well when the SCSSV or plug is closed since fluid can pass through the annular area between the SCSSV or plug and the nipple due to the irregularities. Operating the well without a safety valve or with a safety valve or plug that does not function properly presents a significant danger. Thus, the current solution to conserve the safety in wells having damaged nipples includes an expensive and time consuming work over to replace the damaged nipples.

Therefore, a need exists for improved apparatus and methods for disposing a plug or SCSSV within tubing regardless of whether the tubing has a damaged or irregular inside surface.

SUMMARY OF THE INVENTION

Embodiments of the invention generally relate to a seal assembly for use in a tubular, comprising a mandrel, a compressible seal member disposed around the mandrel, a first piston assembly in contact with a first end of the compressible seal member, and a second piston assembly in contact with a second end of the compressible seal member. The first piston assembly may include a piston head, and a piston extension sealing member extending at least partially between the mandrel and of the compressible seal member, and integrally formed with the piston head. When at least one of the piston assemblies is urged towards the compressible seal member, the compressible seal member forms a seal with the tubular.

In one embodiment, the invention relates to an apparatus for use in a tubular, which may comprise a mandrel having a bore therethrough, a valve that is coupled to the mandrel, the valve selectively preventing fluid flow through the bore, and a seal assembly disposed around the mandrel. The seal assembly may include a compressible seal member and a piston assembly disposed on a first side of the compressible seal member. The piston assembly may include a piston head and a piston extension sealing member, the piston extension sealing member integrally formed with the piston head and extending at least partially between the mandrel and the compressible seal member. The piston assembly is movable to compress the compressible seal member from a first end, and the compressible seal member forms a seal with the tubular when the piston assembly moves toward the compressible seal member.

The invention also generally relates to method for creating a seal between an apparatus and a tubular, including positioning the apparatus in the tubular. The apparatus may include a seal assembly disposed around a mandrel, the seal assembly comprising a compressible seal member, a first piston assembly disposed on a first side of the compressible seal member, and a second piston assembly disposed on a second side of the compressible seal member. The first piston assembly may include a first piston head and a first piston extension sealing member, the first piston extension sealing member integrally formed with the first piston head and extending at least partially between the mandrel and the compressible seal member. The method for creating a seal between an apparatus and a tubular further includes moving at least one of the first or second piston assemblies towards the compressible seal member until the compressible seal member forms a seal with the tubular.

In one embodiment, the invention relates to a seal assembly for use in a tubular, which may comprise a mandrel, a compressible seal member disposed around the mandrel, a first sealing element at a first end of the compressible seal member, and a second sealing element at a second end of the compressible seal member. The compressible seal member forms a seal with the tubular when at least one of the first or second sealing elements is urged toward the compressible seal element. In addition, the first and second sealing elements may also form a seal with the tubular.

In one embodiment, the invention relates to a seal assembly for use in a tubular, comprising a mandrel and a compressible seal member disposed around the mandrel. The seal member comprises a plurality of concave sealing elements and a central sealing element. The seal assembly further comprises a first piston assembly in contact with a first end of the compressible seal member, the first piston assembly comprising a piston head and a piston extension sealing element extending at least partially between the mandrel and the compressible seal member, and integrally formed with the piston head. The seal assembly also comprises a second piston assembly in contact with a second end of the seal member, a first sealing element in contact with the first piston assembly, and a second sealing element in contact with the second piston assembly. When the first and second sealing elements are compressed, the sealing elements move the first and second piston assemblies toward the compressible seal member. Further, when at least one of the piston assemblies is urged towards the compressible seal member, the compressible seal member forms a seal with the tubular.

In one embodiment, the invention relates to a seal assembly for use in a tubular, comprising a mandrel, a compressible seal member, and a piston. The mandrel includes a first and second recess. The compressible seal member may be positioned around the first recess of the mandrel, and the compressible seal member may comprise a plurality of concave sealing elements and a central sealing element. The piston is in contact with the compressible seal member, and the piston may slide along the first and second recesses of the mandrel. The compressible seal member forms a seal with the tubular when the piston is urged toward the compressible seal member.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the invention generally relate to seal assemblies for any type of safety valve, dummy valve, straddle or plug designed to be landed and set within a tubular member. For some embodiments, the tubular member may form a ported landing nipple to enable fluid actuation of the safety valve, a side pocket mandrel, a sliding sleeve valve or a solid walled landing nipple. The seal assembly may be implemented with other variations of plugs, dummy valves, and subsurface safety valves different than exemplary configurations and designs shown and described herein since many operational details of these tools function independent of the seal assembly. For example, the seal assemblies may be used in all types of tools designed for landing in a nipple including wireline retrievable tools that may utilize flapper type valves or concentric type valves.

Figure 1:
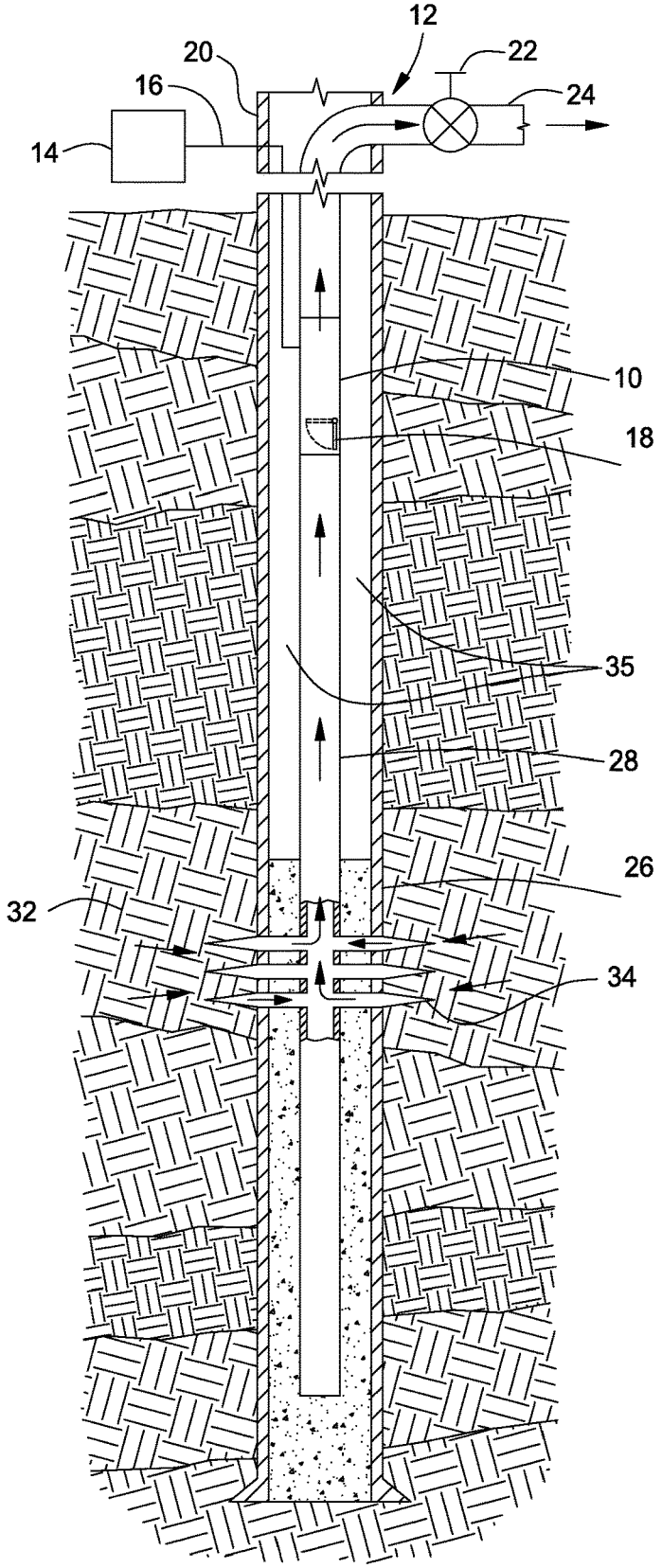
FIG. 1 is a schematic of a production well having a surface controlled, subsurface safety valve (SCSSV) installed therein.

FIG. 1 illustrates a production well 12 having an SCSSV 10 installed therein according to aspects of the invention as will be described in detail herein. While a land well is shown for the purpose of illustration, the SCSSV 10 may also be used in offshore wells. FIG. 1 further shows a wellhead 20, surface equipment 14, a master valve 22, a flow line 24, a casing string 26 and a production tubing 28. In operation, opening the master valve 22 allows pressurized hydrocarbons residing in the producing formation 32 to flow through a set of perforations 34 that permit and direct the flow of hydrocarbons into the production tubing 28. Hydrocarbons (illustrated by arrows) flow into the production tubing 28, through the SCSSV 10, through the wellhead 20, and out into the flow line 24. The SCSSV 10 is conventionally set and locked in a profile within the production tubing 28. Surface equipment 14 may include a pump, a fluid source, sensors, etc. for selectively providing hydraulic fluid pressure to an actuator (not shown) of the SCSSV 10 in order to maintain a flapper 18 of the SCSSV 10 in an open position. A control line 16 resides within the annulus 35 between the production tubing 28 and the casing string 26 and supplies the hydraulic pressure to the SCSSV 10.

Figure 2:
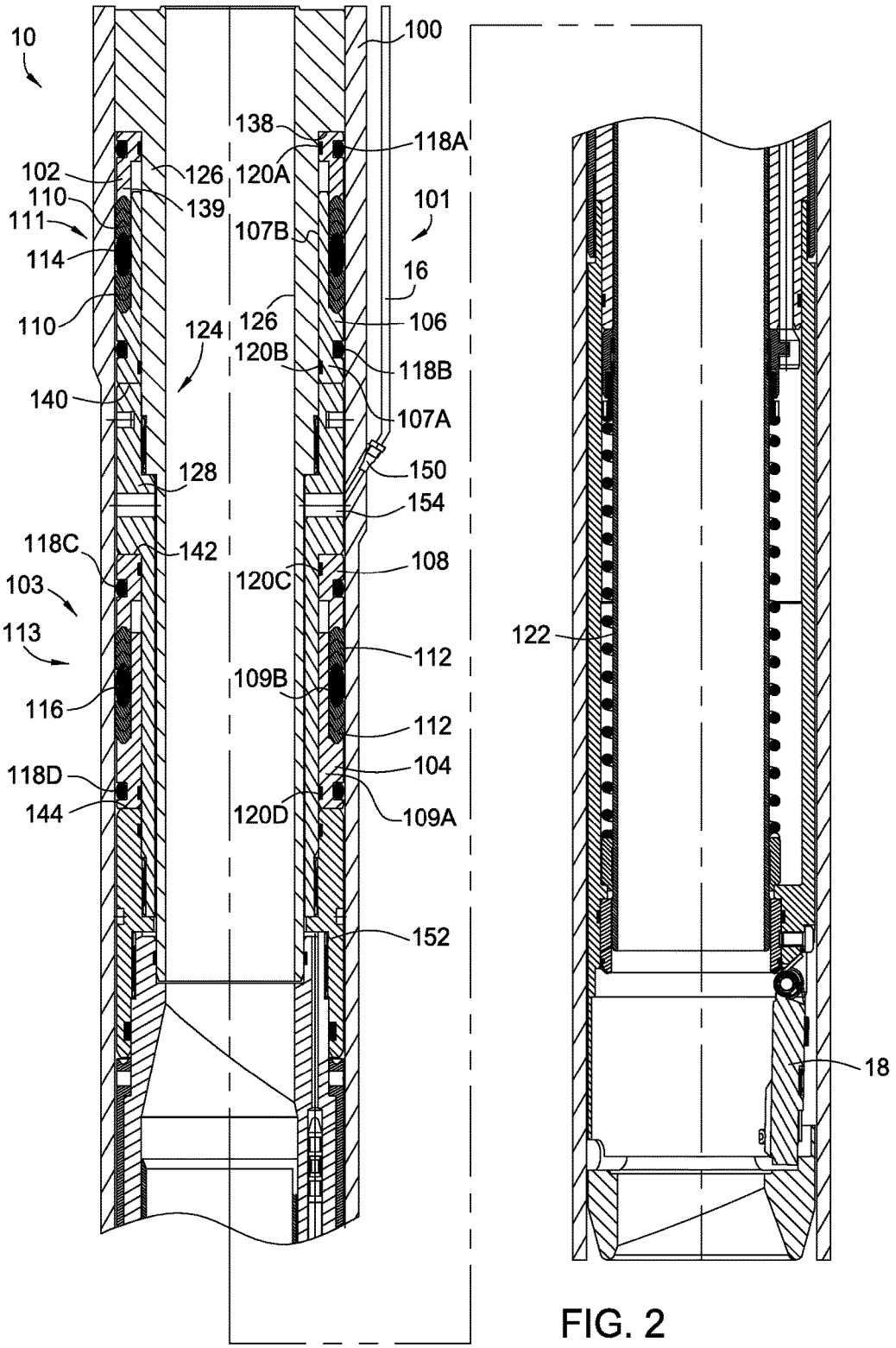
FIG. 2 is a sectional view of the SCSSV within a landing nipple during run-in of the SCSSV illustrating one embodiment of seal assemblies of the SCSSV in an uncompressed position.

FIG. 2 illustrates a sectional view of the SCSSV 10 within a landing nipple 100 as part of the production tubing. The SCSSV 10 is shown in a run-in position prior to setting of the SCSSV 10 within the landing nipple 100. As shown, the SCSSV 10 includes an upper seal assembly 101 and a lower seal assembly 103 around its exterior, a packing mandrel 124 disposed inside the seal assemblies 101, 103, and an actuator housing 152 connected to the lower end of the packing mandrel 124. An exemplary actuator is a spring. The upper seal assembly 101 is compressible and includes an upper seal member 111 formed by upper concave seal elements 110 disposed on each side of an upper central sealing element 114. The upper central sealing element 114 could be an o-ring, s-seal, or any other type of sealing element known in the art. Upper concave seal elements 110 could include V-seals, chevron seals, or any other type of sealing element known in the art. An upper first piston 102 is in contact with an upper end of the upper concave seal elements 110, and an upper second piston 106 is in contact with a lower end of the upper concave seal elements 110. The upper second piston 106 comprises an upper piston head 107A and an upper piston extension sealing member 107B which may be integrally formed and that extends between the upper seal member 111 and the mandrel 124. In one embodiment, the upper piston extension sealing member 107B of the upper second piston 106 may slide under a portion of the upper first piston 102.

Similarly, the lower seal assembly 103 is compressible and includes a lower seal member 113 formed by lower concave seal elements 112 disposed on each side of a lower central sealing element 116. The lower central sealing element 116 could be an o-ring, s-seal, or any other type of sealing element known in the art. Lower concave seal elements 112 could include V-seals, chevron seals, or any other type of sealing element known in the art. A lower first piston 104 is in contact with a lower end of the lower concave seal elements 112, and a lower second piston 108 is in contact with an upper end of the lower concave seal elements 112. The lower first piston 104 comprises a lower piston head 109A and a lower piston extension sealing member 109B that extends between the lower seal 113 and the mandrel 124. In one embodiment, the lower piston extension sealing member 109B of the lower second piston 104 may slide under a portion of the lower first piston 108. The pistons 102, 106, 108, 104 are preferably annular pistons. While both the upper and lower seal assemblies 101, 103 are shown in the embodiment in FIG. 2, the SCSSV 10 may include only one of either the upper or lower seal assemblies 101, 103. Additionally, other variations of the seal members 111, 113 may be used so long as the pistons 102, 106, 108, 104 can operate to force the seal members 111, 113 into sealing contact with the nipple 100.

The packing mandrel 124 includes an upper sub 126 and a middle sub 128 connected together such as by threads. However, the packing mandrel 124 may be made from an integral member or any number of subs. An annular shoulder 138 on the upper sub 126 provides a decompression stop for the upper first piston 102, which is slidable along a portion of an outer diameter of the upper sub 126. The upper piston extension sealing member 107B of the upper second piston 106 provides a compression stop for the upper first piston 102. Likewise, the upper first piston 102 provides a compression stop for the upper second piston 106. The upper second piston 106 is slidable along portions of the outer diameter of the upper sub 126 and the upper piston extension sealing member 107B is slidable between the upper concave sealing elements 110 and the upper sub 126. The middle sub 128 is fixed to the upper sub 126 and operates to longitudinally separate the upper and lower seal assemblies 111, 113. The middle sub 128 provides a decompression stop for the upper second piston 106 and a decompression stop for the lower second piston 108. The lower second piston 108 is slidable along a portion of the outer diameter of the middle sub 128. The lower piston extension sealing member 109B of the lower first piston 104 provides a compression stop for the lower second piston 108. Likewise, the lower second piston 108 provides a compression stop for the lower first piston 104. The lower first piston 104 is slidable along a portion of the outer diameter of the middle sub 128 and the lower piston cylinder 109B is slidable between the lower concave sealing elements 112 and the middle sub 128. An end face 144 of the actuator housing 152 provides a decompression stop for the lower first piston 104.

The compression and decompression stops operate to limit the sliding movement of the pistons 102, 106, 108, 104 of the sealing assemblies 101, 103. Inner seal members 120 A-D on the inside of the pistons 102, 106, 108, 104 provide a seal between each piston and the packing mandrel 124 that the pistons slide along. Outer seal members 118 A-D on the outside of the pistons 102, 106, 108, 104 provide an initial seal between each piston and the nipple 100. The outer seals 118 may be soft o-rings, or any other type of seal known in the art, with a large cross section to help ensure a sufficient initial seal between the pistons 102, 106, 108, 104 and the nipple 100. Thus, the initial seal provided by the outer seal members 118 sufficiently seals against the nipple 100 such that fluid pressure applied to the large surface areas of the pistons 102, 106, 108, 104 that are shown in contact with the decompression stops 138, 140, 142, 144 causes the pistons to slide along the packing mandrel 124 toward the respective seal 111, 113.

In the run in position of the SCSSV 10 as shown in FIG. 2, the seal assemblies 101, 103 are in uncompressed positions with all the pistons 102, 106, 108, 104 contacting their respective decompression stops 138, 140, 142, 144. Therefore, the upper and lower seal members 111, 113 are not compressed and may not provide sealing contact with the inside surface of the nipple 100 and the outside of the packing mandrel 124. During run-in all parts of the SCSSV 10 are in equal pressure so that the pistons 102, 106, 108, 104 do not move. In the run-in position, the SCSSV 10 is temporarily held open by a running tool (not shown) using a run-in prong or other temporary opening member. Since the SCSSV 10 is open, wellbore fluid pressure does not act on the first pistons 102, 104 to compress the upper and lower seal members 111, 113. Further, fluid pressure is not supplied through the control line 16 such that the second pistons 102, 106 are also not acted on to compress the upper and lower seal members 111, 113.

Once the SCSSV 10 is set or locked in the nipple 100 by conventional methods, the temporary opening member disengages and permits normal functioning of the SCSSV 10. Thus, the flapper 18 biases to a closed position unless fluid pressure is supplied through the control line 16 to a port 150 in the nipple 100 in order to actuate the SCSSV 10.

Figure 3:
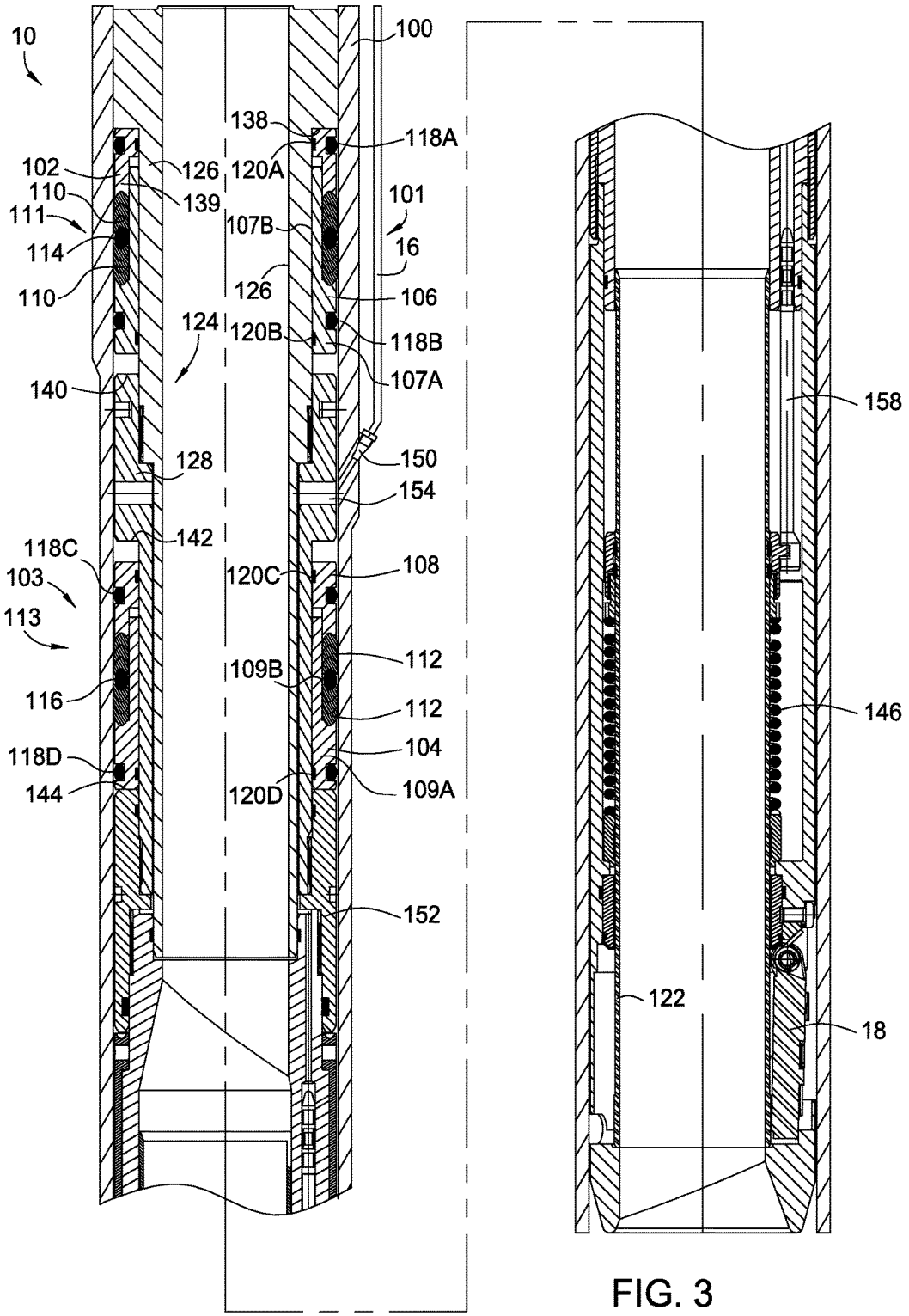
FIG. 3 is a sectional view of the SCSSV set in the nipple and actuated to an open position illustrating the seal assemblies in a first compressed position.

FIG. 3 is a sectional view of the SCSSV 10 in an actuated open position with the seal assemblies 101, 103 in a first compressed position. Fluid pressure supplied through the control line 16 to the port 150 in the nipple 100 passes through a fluid passageway 154 into an annular area outside the upper sub 126. The fluid pressure acts on a piston rod 158 connected to a flow tube 122 to force the flow tube down against the bias of a biasing member such as a spring 146. The longitudinal displacement of the flow tube 122 causes the flow tube 122 to displace the flapper 18 and place the SCSSV 10 in the actuated open position. As an example of an SCSSV actuated by a concentric piston, the fluid pressure may alternatively act on an outward facing shoulder of a flow tube located concentrically within the packing mandrel to force the flow tube down and open a flapper.

The fluid pressure supplied through the control line 16 used to actuate and open the SCSSV 10 additionally operates to place the seal assemblies 101, 103 in the first compressed position. The fluid pressure supplied from the control line 16 enters the port 150 where the fluid enters the interior of the nipple 100 and acts on the second pistons 106, 108 to slide the second pistons 106, 108 toward the respective seal members 111, 113. Any wellbore pressure on the first pistons 102, 104 is less than that on the second pistons 106, 108 such that the first pistons 102, 104 remain in contact with their respective decompression stops 138, 144. The sliding movement of the second pistons 106, 108 pushes on the concave sealing elements 110, 112, which in turn pushes on the central sealing elements 114, 116. Compression of the seal members 111, 113 caused by the sliding of the second pistons 106, 108 forces the central sealing elements 114, 116 and/or the concave sealing elements 110, 112 into sealing contact with the inside surface of the nipple 100. Preferably, the central sealing elements 114, 116 are soft o-rings with a large cross section made from a material such as Viton® (65 duro). However, the central sealing elements 114, 116 could be S-Seals or any other type of sealing element known in the art. Additionally, the chevrons 110, 112 are preferably made from a material such as Kevlar® filled Viton®, but also could be any other sealing element known in the art. Once the SCSSV is actuated open, wellbore fluid passes through the SCSSV 10 such that wellbore fluid pressure does not act to slide the first pistons 102, 104, and the first pistons 102, 104 remain in contact with their respective decompression stops 138, 144.

Figure 4:
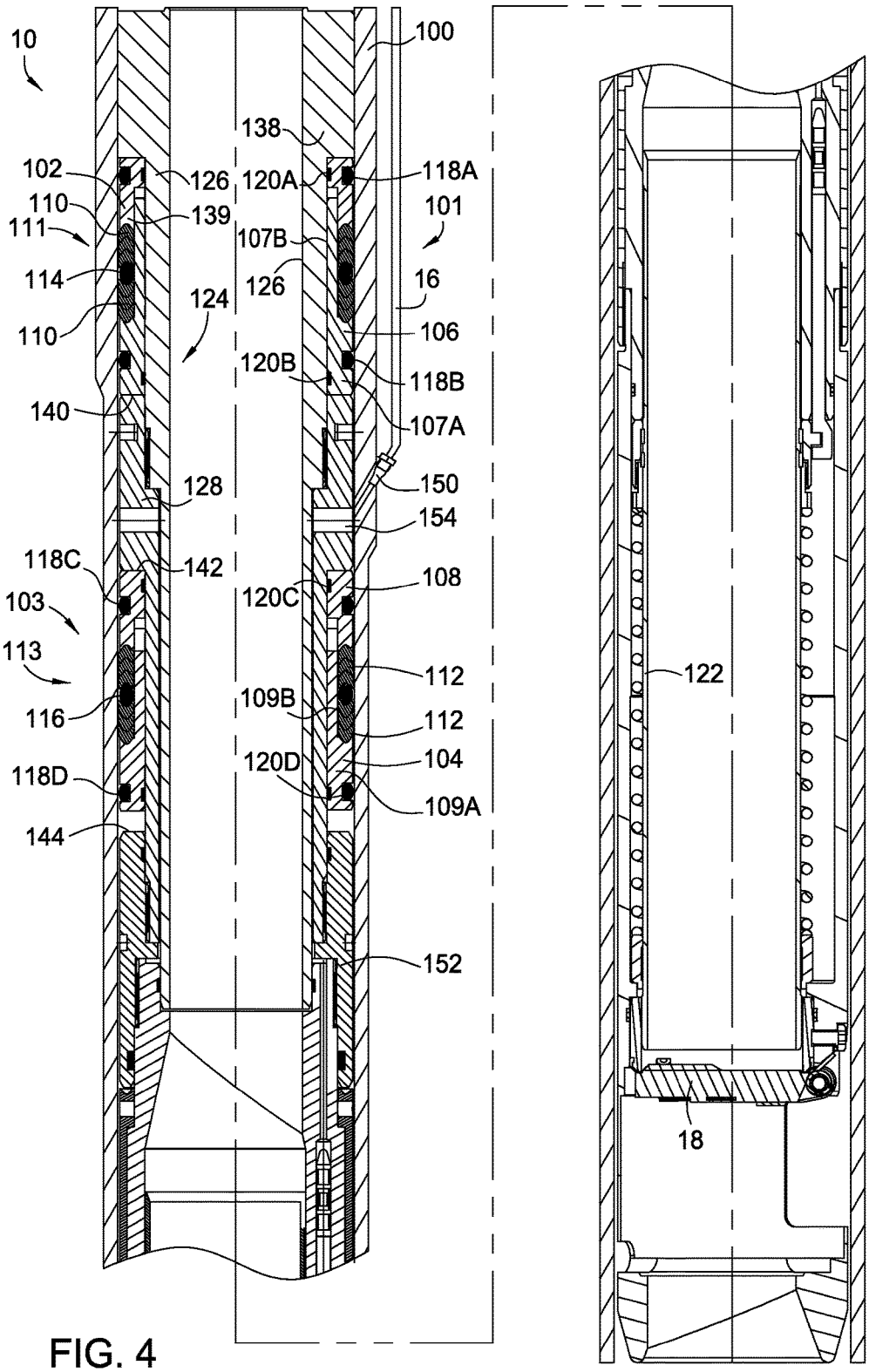
FIG. 4 is a sectional view of the SCSSV set in the nipple and biased to a closed position illustrating the seal assemblies in a second compressed position.

FIG. 4 is a sectional view of the SCSSV 10 set in the nipple 100 and biased to the closed position with the seal assemblies 101, 103 in a second compressed position and the flapper 18 blocking fluid flow through the SCSSV 10. As fluid pressure bleeds from the control line 16 during closure of the SCSSV 10, the fluid pressure acting on the second pistons 106, 108 approaches hydrostatic pressure, which along with the wellbore pressure acting on the first pistons 102, 104 keeps the seals 111, 113 compressed. When the wellbore pressure is greater than the pressure supplied by the control line 16, the wellbore pressure acts on the first pistons 102, 104 to slide the first pistons 102, 104 toward the respective seal members 111, 113. For example, wellbore fluid pressure above the SCSSV 10 acts on the upper first piston 102, and wellbore fluid pressure below the SCSSV 10 acts on the lower first piston 104. The second pistons 106, 108 slide into contact with their respective decompression stops 140, 142. The sliding movement of the first pistons 102, 104 pushes on the concave sealing elements 110, 112, which in turn pushes on the central sealing elements 114, 116. Therefore, compression of the seal members 111, 113 caused by the sliding of the first pistons 102, 104 maintains sealing contact with the inside surface of the nipple 100 since the central sealing elements 114, 116 and/or the concave sealing elements 110, 112 remain forced against the inside surface of the nipple 100.

In both the first and second compressed positions as illustrated by FIGS. 3 and 4 respectively, the upper and/or the lower seal members 111, 113 form a fluid seal with an inside surface of the nipple 100 that may have irregularities, grooves, recesses, and/or ridges that would prevent prior SCSSVs from properly sealing within the nipple 100. Additionally, the sealing ability of the upper and/or the lower seal members 111, 113 with the concave sealing elements 110, 112 around the central sealing members 114, 116 increases with increased pressure to the pistons 102, 106, 108, 104. As shown, the SCSSV provides an annular recess to provide a flow path to operate the SCSSV, and the seal assemblies 101, 103 do not interfere with the flow path through the SCSSV 10.

A method for sealing an SCSSV within a nipple located in a well is provided by aspects of the invention. The method includes locating the SCSSV in the nipple using conventional running methods. The SCSSV includes at least one seal assembly disposed about an outer surface thereof, and the at least one seal assembly includes a seal member, a first piston disposed on a first side of the seal member, and a second piston disposed on a second side of the seal member. Urging the first piston, the second piston or both the first and second pistons toward the seal member forces the seal member into sealing contact with an inside surface of the nipple. Urging the first piston is caused by wellbore fluid pressure applied to the first piston when the SCSSV is closed. Urging the second piston is caused by fluid pressure supplied from a control line to a fluid port in fluid communication with an inside portion of the nipple.

Figure 5:
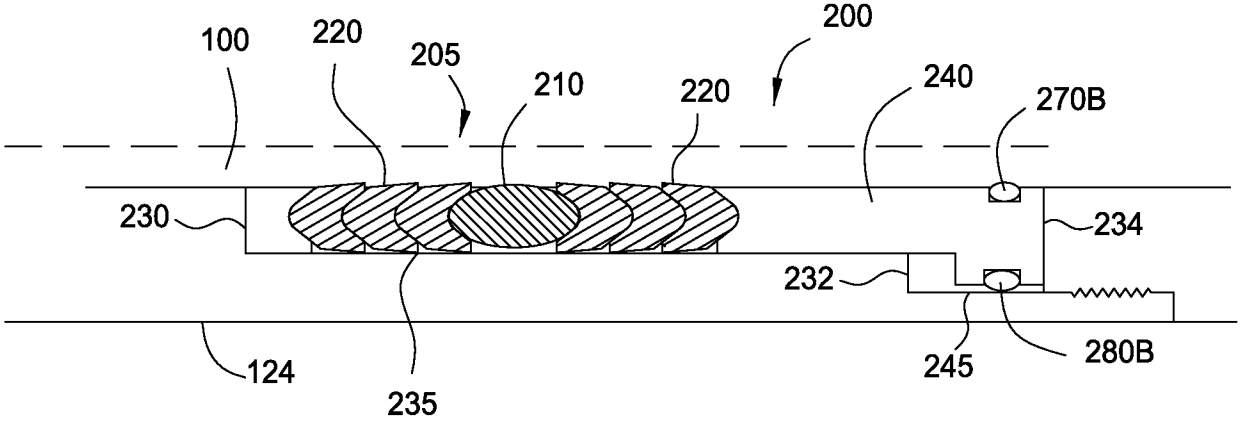
FIG. 5 is a sectional view of one embodiment of a seal assembly that could be used in the SCSSV.

Other seal assemblies 111, 113 are also contemplated within the current invention. FIG. 5 illustrates one embodiment of a seal assembly 200 that could be used in place of one or both of the seal assemblies 101, 103 shown in FIGS. 2-4. The seal assembly 200 may include a compressible sealing member 205 formed by a central sealing element 210 located between concave sealing elements 220 such as V-seals or chevrons, or any other sealing element known in the art on each side of the central sealing element 210. A mandrel 124 includes a first, second, and third shoulder 230, 232, 234 (respectively), and further includes a first recess 235 located between the first and second shoulders 230, 232, and a second recess 245 located between the second and third shoulders 232, 234. The compressible sealing member 205 is positioned between the first recess 235 and the nipple 100 and is located at a first end of the first recess 235. A piston 240 is adjacent the compressible sealing member 205, and is located at a second end of the first recess, as well as within the second recess 245. The piston 240 is slidable along the first and second recesses 235, 245, and has end stops at the second and third shoulders 232, 234. The piston 240 may include sealing elements 270B, 280B for providing an initial seal between the nipple 100 and the mandrel 124. The piston 240 slides between the nipple 100 and the first and second recesses 235, 245 to compress the compressible sealing member 210. As the piston 240 is moved toward the compressible sealing member 205, a seal is formed between the nipple 100 and the first recess 235 of the mandrel 124.

Figure 6:
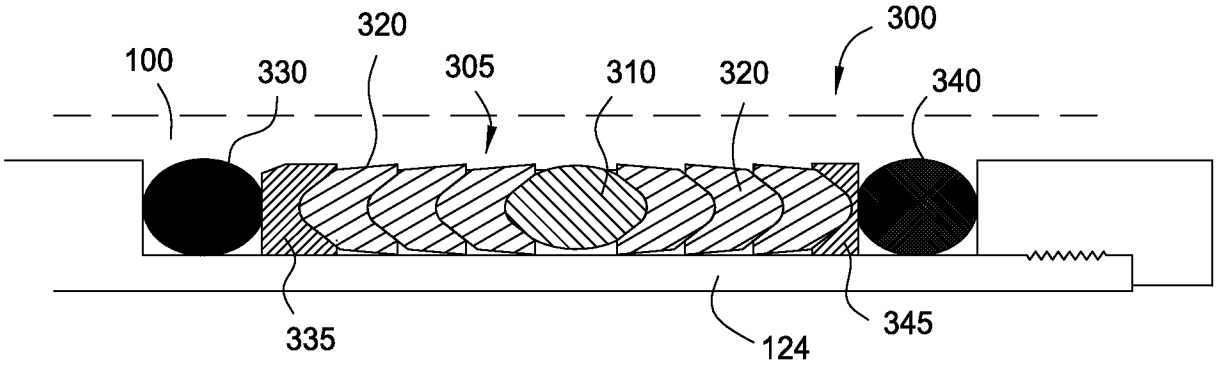
FIG. 6 is a sectional view of one embodiment of a seal assembly that could be used in the SCSSV.

FIG. 6 illustrates another embodiment of a seal assembly 300 that could be used in place of one or both of the seal assemblies 101, 103 shown in FIGS. 2-4. Seal assembly 300 may include a compressible seal member 305 formed by a central sealing element 310 located between concave sealing elements 320 such as V-seals or chevrons, or any other sealing element known in the art on each side of the central sealing element 310. A first sealing element 330 is in contact with a shoulder 335 adjacent to a first end of the concave sealing elements 320, and a second sealing element 340 in contact with a second shoulder 345 adjacent to a second end of the concave sealing elements 220. The first and second sealing elements 330, 340 may be o-rings, s-type seals, polypacks, or any other type of seal known in the art, and may provide an initial seal against the nipple 100 and the mandrel 124. The mandrel 124 provides a stop to the first and second sealing elements 330, 340. As pressure is applied to the first and second sealing elements 330, 340, the first and second sealing elements 330, 340 are compressed and slide along packing sub 124, which then compresses the concave sealing elements 320 and the central sealing element 310. When the concave sealing elements 320 and the central sealing element 310 are compressed, a seal is formed against the inside surface of the nipple 100.

Figure 7:
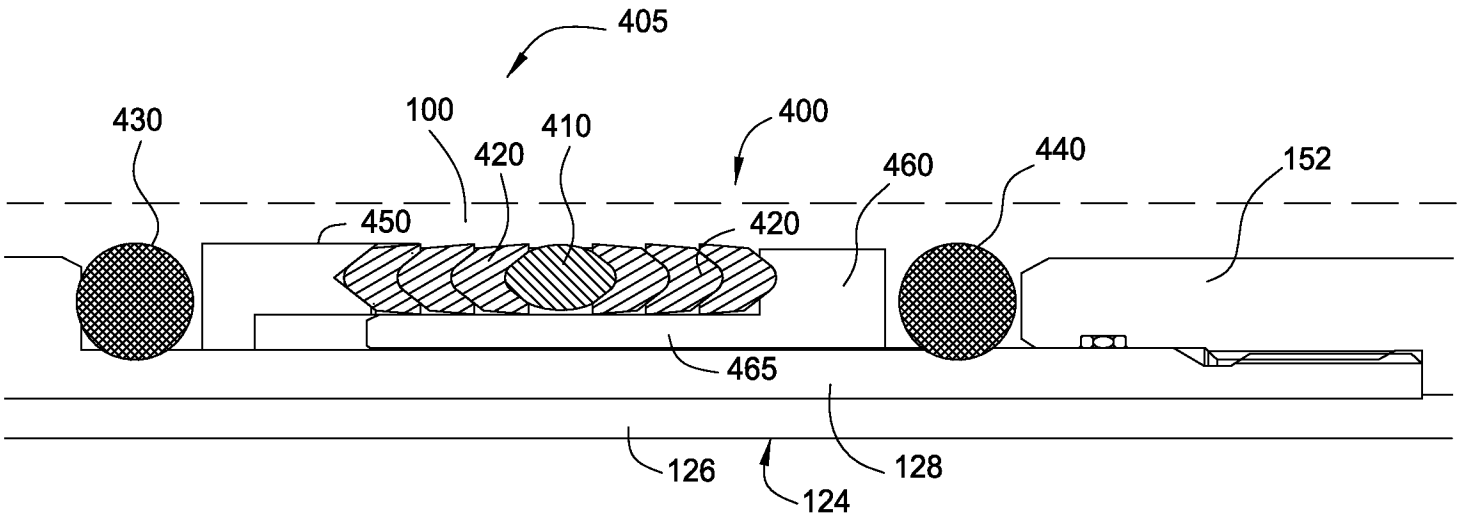
FIG. 7 is a sectional view of one embodiment of a seal assembly that could be used in the SCSSV.

FIG. 7 illustrates another embodiment of a seal assembly 400 that could be used in place of one or both of the seal assemblies 101, 103 shown in FIGS. 2-4. The seal assembly 400 may include a compressible seal member 405 formed by a central sealing element 410 located between concave sealing elements 420 such as V-seals or chevrons on each side of the central sealing element 410. A first piston 430, which comprises a sealing element such as an o-ring or any other sealing element known in the art, and a first packing retainer 450 are adjacent to a first end of the concave sealing elements 420. A second piston 440, which comprises a sealing element such as an o-ring or any other sealing element known in the art, and a second packing retainer 460 are adjacent to a second end of the concave sealing elements 420. The second packing retainer 460 includes a packing retainer extension 465, and the packing retainer extension 465 slides between the concave sealing elements 420 and the middle sub 128, and provides a compression stop for first piston 430. In addition to acting as pistons to the seal assembly 400, the first and second pistons 430, 440 also provide an initial seal between the nipple 100 and the middle sub 128. As pressure is applied to the first and second pistons 430, 440, the first and second pistons 430, 440 are compressed, and move toward the compressible seal member 405, thereby resulting in the compressible seal member 405 forming a seal against the nipple 100.

While the foregoing is directed to embodiments of the invention, other and further embodiments of the invention may be devised without departing from the basic scope thereof, and the scope thereof is determined by the claims that follow.

The invention claimed is:

1. A seal assembly for use in a tubular, comprising:

a mandrel;

a compressible seal member disposed around the mandrel;

a first movable piston in contact with a first end of the seal member, the first piston comprising:

a piston head, and a piston extension sealing member extending at least partially between the mandrel and the compressible seal member, and integrally formed with the piston head; and a second movable piston in contact with a second end of the compressible seal member, wherein the compressible seal member forms a seal with the tubular when at least one of the pistons is urged toward the seal member, and wherein the first piston and the second piston are movable relative to the mandrel.

2. The seal assembly of claim 1, wherein the piston extension sealing member can prevent longitudinal movement of the second piston.

3. The seal assembly of claim 1, wherein the compressible seal member comprises a plurality of concave sealing elements and a central sealing element.

4. The seal assembly of claim 1, wherein wellbore pressure is used to move at least one of the first or second pistons toward the compressible seal member.

5. The seal assembly of claim 1, wherein fluid pressure is used to move at least one of the first or second pistons toward the compressible seal member.

6. A method for creating a seal between an apparatus and a tubular, comprising:

positioning the apparatus in the tubular, the apparatus including:

a seal assembly disposed around a mandrel, the seal assembly comprising:

a compressible seal member, a first movable piston disposed on a first side of the compressible seal member, the first piston comprising a first piston head and a first piston extension sealing member, the first piston extension sealing member integrally formed with the first piston head and extending at least partially between the mandrel and the compressible seal member, and a second movable piston disposed on a second side of the compressible seal member, wherein the first piston and the second piston are movable relative to the mandrel; and moving at least one of the first or second pistons towards the compressible seal member until the compressible seal member forms a seal with the tubular.

7. The method of claim 6, further comprising injecting fluid into the apparatus in order to move at least one of the first or second pistons toward the compressible seal member.

8. The method of claim 6, further comprising using wellbore pressure to move at least one of the first or second pistons toward the compressible seal member.

9. The method of claim 6, wherein the apparatus further include a second seal assembly, the second seal assembly including:

a second compressible seal member, a third movable piston disposed on a first side of the second compressible seal member, the third piston assembly comprising a third piston head and a third piston extension sealing member, the third piston extension sealing member integrally formed with the third piston head and extending at least partially between the mandrel and the second compressible seal member, and a fourth movable piston disposed on a second side of the second compressible seal member: and the method further comprising moving at least one of the third or fourth pistons toward the second compressible seal member until the second seal member forms a seal with the tubular.

10. The method of claim 9, wherein the first and fourth pistons are moved toward the first and second compressible seal members, respectively, at the same time.

11. The method of claim 9, wherein fluid pressure is used to move the first and fourth pistons.

12. The method of claim 9, wherein the second and third pistons are moved toward the first and second seal members, respectively, at the same time.

13. The method of claim 9, wherein wellbore pressure is used to move the second and third pistons.

14. The seal assembly of claim 1, where the piston extension sealing member sealingly contacts the mandrel.

* * * * *